US011421717B2

(12) United States Patent
Klassen et al.

(10) Patent No.: US 11,421,717 B2
(45) Date of Patent: Aug. 23, 2022

(54) SYSTEM AND METHOD INCLUDING A FLUIDIC ACTUATOR AND A PRESSURIZED FLUID PROVISION DEVICE

(71) Applicant: Festo SE & Co. KG, Esslingen (DE)

(72) Inventors: Daniel Klassen, Esslingen (DE); David Rager, Nürtingen (DE); Valentin Falkenhahn, Stuttgart (DE)

(73) Assignee: Festo SE & Co. KG, Esslingen (DE)

( * ) Notice: Subject to any disclaimer, the term of this patent is extended or adjusted under 35 U.S.C. 154(b) by 185 days.

(21) Appl. No.: 16/829,558

(22) Filed: Mar. 25, 2020

(65) Prior Publication Data

US 2020/0309161 A1 Oct. 1, 2020

(30) Foreign Application Priority Data

Mar. 29, 2019 (DE) ..... 102019204496.4

(51) Int. Cl.
*F15B 19/00* (2006.01)
*F15B 11/072* (2006.01)
(Continued)

(52) U.S. Cl.
CPC ..... *F15B 19/002* (2013.01); *F15B 11/0725* (2013.01); *F15B 11/10* (2013.01); *F15B 11/126* (2013.01); *F15B 2211/30575* (2013.01); *F15B 2211/634* (2013.01); *F15B 2211/6306* (2013.01); *F15B 2211/6309* (2013.01); *F15B 2211/6313* (2013.01);
(Continued)

(58) Field of Classification Search
CPC .... F15B 11/006; F15B 11/126; F15B 19/002; F15B 2211/6336
USPC ..... 91/361, 363 R
See application file for complete search history.

(56) References Cited

U.S. PATENT DOCUMENTS 4,513,782 A * 4/1985 Contartese ..... F15B 21/087 137/625.63
4,901,625 A * 2/1990 Bussan ..... G05B 19/231 91/361
(Continued)

FOREIGN PATENT DOCUMENTS

DE 102009022891 B3 11/2010
DE 102009033214 B4 2/2011
DE 102016222153 A1 5/2018

*Primary Examiner* — Michael Leslie
(74) *Attorney, Agent, or Firm* — Hoffmann & Baron LLP

(57) ABSTRACT

A system (100), including: a fluidic actuator (2) which can be acted upon by a pressurized fluid and has an actuator member (3), a pressurized fluid provision device (4) which is adapted to carry out a position control of the actuator member (3) and, within the position control, to apply the pressurized fluid to the fluidic actuator (2) in order to move the actuator (3) into a prescribed position, the pressurized fluid provision device (4) being adapted to carry out the position control taking into account at least one system parameter, which describes a physical property of the system and/or a requirement parameter which defines a requirement for the positioning of the actuator (3), wherein the pressurized fluid provision device (4) is further adapted to perform an assistance procedure and to determine and/or verify, within the assistance procedure, the system parameter and/or the requirement parameter on the basis of a movement of the actuator (3) and/or a consideration of physical limits.

8 Claims, 2 Drawing Sheets

(51) Int. Cl.
*F15B 11/10* (2006.01)
*F15B 11/12* (2006.01)

(52) U.S. Cl.
CPC ..... *F15B 2211/6336* (2013.01); *F15B 2211/7053* (2013.01); *F15B 2211/765* (2013.01); *F15B 2211/8855* (2013.01)

(56) References Cited

U.S. PATENT DOCUMENTS 5,031,506 A * 7/1991 Baisch ..... G05D 3/1454 91/363 R
5,088,383 A * 2/1992 Wardle ..... F15B 13/07 137/596.15
6,234,060 B1 * 5/2001 Jolly ..... F15B 15/26 91/361
6,523,451 B1 * 2/2003 Liao ..... F15B 9/09 91/363 R
8,146,481 B2 * 4/2012 Hoshino ..... F15B 21/08 91/361

* cited by examiner

SYSTEM AND METHOD INCLUDING A FLUIDIC ACTUATOR AND A PRESSURIZED FLUID PROVISION DEVICE

BACKGROUND OF THE INVENTION

The invention pertains to a system comprising a fluidic actuator which can be acted upon with a pressurized fluid, the actuator having an actuator member. The system further comprises a pressurized fluid provision device which is adapted to perform position control of the actuator member and, within the position control, to apply the pressurized fluid to the fluidic actuator in order to move the actuator member to a prescribed position. The pressurized fluid provision device is adapted to perform the position control taking into account at least one system parameter describing a physical property of the system and/or at least one requirement parameter defining a requirement for the positioning of the actuator member.

The pressurized fluid provision device includes, for example, a valve island connected to the fluidic actuator via a hose. The fluidic actuator is for example a pneumatic drive cylinder. The valve island may also be referred to as valve terminal or valve manifold.

Expediently, the system is used in industrial automation, for example to position via the actuator member a drive object, such as a tool, a workpiece and/or a machine part.

The fluidic actuator comprises one or more pressure chambers which are, within the position control, pressurized by the application of the pressurized fluid in order to effect the positioning of the actuator member. A position control by means of the application of pressurized air is also referred to as servo-pneumatics. The position control is a closed-loop position control.

The position control provided by the pressurized fluid provision device can be expediently used for a variety of different applications and/or together with different fluidic actuators. Furthermore, the dynamic behavior of a valve device of the pressurized fluid provision device may vary. In order to enable an optimal—in particular a highly accurate and/or fast—position control, it is usually necessary to adapt the position control via parameters—for example the system parameter and/or the requirement parameter—to the respective application and/or the respectively used fluidic actuator and/or the respectively used valve device.

Expediently, the system parameter and/or the requirement parameter is entered at the location of use (for example, during start-up) into the pressurized fluid provision device, exemplarily into an application program that provides the position control.

SUMMARY OF THE INVENTION

It is an object of the invention to modify the system mentioned at the beginning in such a way that it becomes easier for a user to achieve an optimal position control.

According to the invention, the pressurized fluid provision unit is adapted to perform an assistance procedure and, within the assistance procedure, to determine and/or verify the at least one system parameter and/or the at least one requirement parameter on the basis of a movement of the actuator member and/or a consideration of physical limits.

In particular, an assistance procedure is provided which comprises one or more supporting functions to help the user to operate the position control with the correct—i.e. optimally adapted to the system—system parameter and/or requirement parameter. By operating the position control with the correct system parameter and/or requirement parameter, a good—i.e. highly accurate and/or fast—position control can be achieved.

The at least one system parameter describes in particular a friction occurring during the positioning of the actuator member, a mass to be set in motion during the positioning of the actuator member and/or a dynamic behavior of a valve device of the pressurized fluid provision device. Expediently, for one, several or each of these quantities, a separate system parameter is given which is determined and/or verified by means of the assistance procedure in the described manner.

Furthermore, there may be plural requirement parameters, which are determined and/or verified by the assistance procedure in the described manner.

It may be difficult for the user to determine the at least one system parameter—for example, the mentioned friction and/or mass—himself. The assistance procedure expediently provides the function of having the system parameter automatically determined by the pressurized fluid provision device, in particular on the basis of a movement of the actuator member. The movement of the actuator member is carried out exemplarily by a learning run and/or in normal operation.

Especially in cases where the user enters the system parameter and/or the requirement parameter into the pressurized fluid provision device, it is possible that (especially due to an misconception or an input error) the entered system parameter and/or requirement parameter is not correct, i.e. in particular it is not adapted to the system. The assistance procedure expediently provides the function of verifying the system parameter and/or requirement parameter (in particular entered by the user), based on a movement of the actuator member and/or taking into account physical limits. The movement of the actuator member is carried out exemplarily by a learning run and/or in normal operation.

According to a preferred embodiment, the pressurized fluid provision device is adapted to use the system parameter determined by the assistance procedure to determine a state of wear, for example an aging state, of the pressurized fluid provision device and/or the fluidic actuator. The pressurized fluid provision device is especially adapted to provide a predictive maintenance function and, for example, to detect aging and/or a defect by using the determined state of wear. In particular, the aforementioned dynamic behavior and/or the aforementioned friction serve as the basis for determining the state of wear.

The invention further pertains to a method of operating the system described above. The method includes the step: performing the assistance procedure.

The method is expediently adapted in correspondence to an embodiment of the system.

BRIEF DESCRIPTION OF THE DRAWINGS

In the following, exemplary details and exemplary embodiments are explained with reference to the figures. Thereby shows.

DETAILED DESCRIPTION

Figure 1:
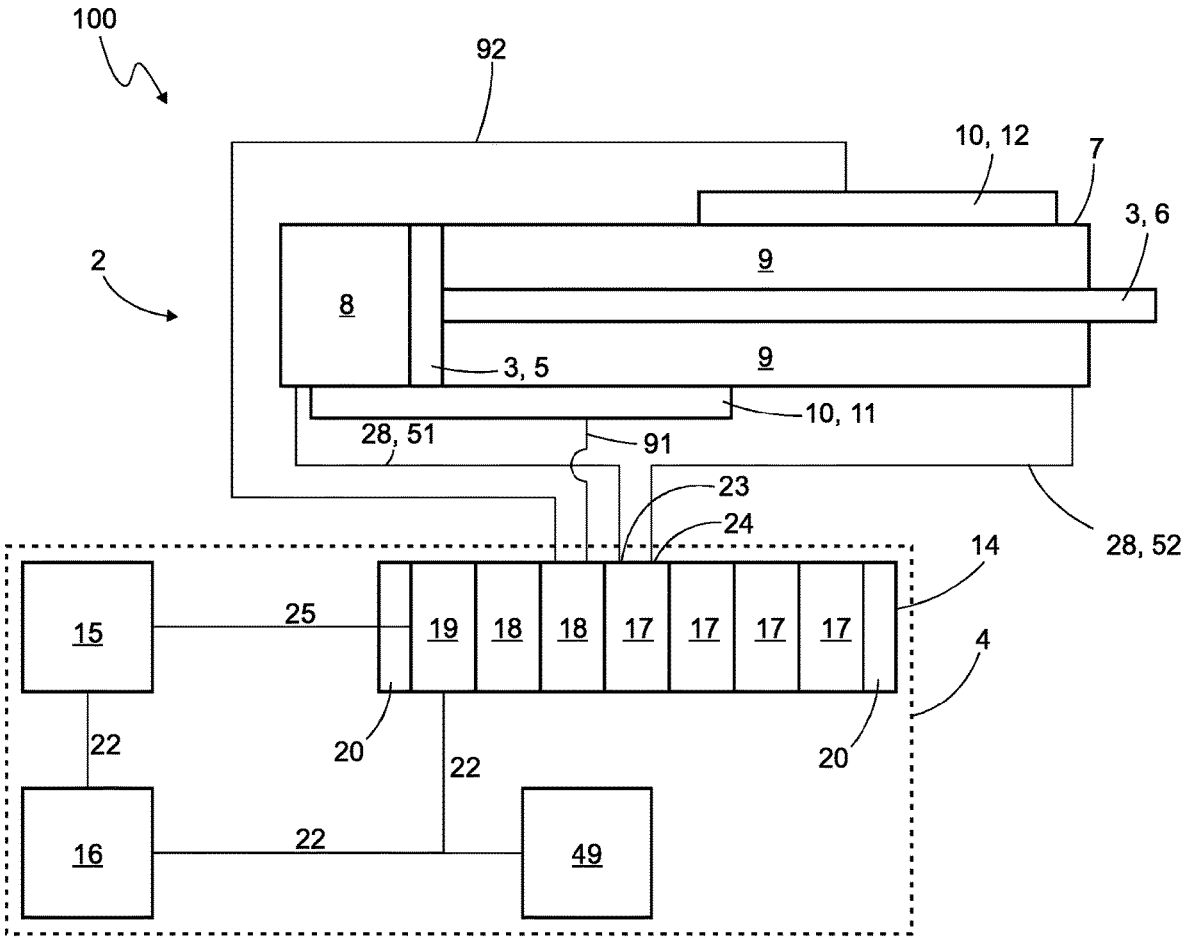
FIG. 1 a schematic view of a system comprising a pressurized fluid provision device, a hose arrangement and a fluidic actuator, and FIG. 2 a schematic view of a valve device.

FIG. 1 shows a system 100 comprising a fluidic actuator 2 which can be acted upon by a pressurized fluid. The fluidic actuator 2 comprises an actuator member 3. The system 100 further comprises a pressurized fluid provision device 4, which is adapted to perform a position control of the actuator member 3 and, within the position control, to apply the pressurized fluid to the fluidic actuator 2 in order to move the actuator member 3 to a prescribed position. The position control is a closed-loop position control.

The pressurized fluid provision device 4 is adapted to perform the position control taking into account at least one system parameter describing a physical property of the system and/or at least one requirement parameter defining a requirement for the positioning of the actuator member 3. The pressurized fluid provision device 4 is further adapted to execute an assistance procedure and, within the assistance procedure, to determine and/or verify the at least one system parameter and/or the at least one requirement parameter on the basis of a movement of the actuator member 3 and/or a consideration of physical limits.

Further exemplary details are explained below.

First of all, the pressurized fluid provision device 4 will be discussed:

The pressurized fluid provision device 4 comprises the valve arrangement 14, which is exemplarily designed as a valve terminal, via which valve arrangement 14 the pressurized fluid is provided for the position control of the actuator 2. The valve arrangement 14 does not necessarily have to be a valve terminal. The valve arrangement 14 may, for example, be designed as a single valve or as a different valve unit.

On the valve arrangement 14, two pressure outputs 23, 24 are provided, to supply the pressurized fluid, in particular pressurized air. Each of the two pressure outputs 23, 24 is fluidically connected to a respective pressure chamber 8, 9 of the fluidic actuator 2. In an alternative design, in which the actuator 2 has only one pressure chamber, only one pressure output is connected to a pressure chamber.

The valve arrangement 14 has a pressure sensor arrangement 29 with pressure sensors by means of which the pressure at the pressure outputs 23, 24 and/or the pressure in a de-aeration port 26 and/or an aeration port 27, can be measured. The de-aeration port 26 may also be referred to as fluid extraction port. The aeration port 27 may also be referred to as fluid supply port. These pressure sensors are expediently located on the valve arrangement 14, especially on the valve terminal. As further explained below with reference to FIG. 2, the pressure sensor arrangement 29 includes, as examples, a first pressure output pressure sensor 45, a second pressure output pressure sensor 46, an exhaust air pressure sensor 43 and/or a supply air pressure sensor 44.

As an example, the valve arrangement 14 comprises a plurality of modules, e.g. valve modules 17 and/or I/O modules 18. The valve arrangement 14 further comprises a control unit 19, which is preferably designed as a module. The valve arrangement 14 has a carrier body 20, in particular a carrier plate, on which the control unit 19, the valve modules 17 and/or the I/O module 18 are arranged. The valve modules 17 are preferably slice-shaped.

The valve arrangement 14 is exemplarily designed as a series module arrangement and can in particular be referred to as a valve terminal. The modules mentioned above are in particular series modules, which are preferably disc-shaped or slice-shaped. In particular, the valve modules 17 are designed as valve discs or valve slices. The series modules are expediently arranged in a row, especially along the longitudinal axis of the valve arrangement 14.

The pressurized fluid provision device 4 further includes, as an example, a superordinate controller 15 and/or optionally a cloud server 16 and/or a user device 49.

The valve arrangement 14 is expediently connected communicatively with the superordinate controller 15 and/or the cloud server 16. Preferably, the valve arrangement 14 is connected to the superordinate controller 15 via a bus 25, in particular a local bus, e.g. a fieldbus, and/or optionally connected to the cloud server 16 via a wide area network 22, e.g. the internet.

The valve arrangement 14 is communicatively connected to a position sensor device 10 of the actuator 2, in particular via the I/O module 18. Exemplarily, the valve arrangement 14 is communicatively connected to the position sensor device 10 via one or more communication lines 91, 92. Expediently, position sensor values recorded by the position sensor device 10 are provided to the control unit 19, the superordinate controller 15 and/or the cloud server 16. Expediently, pressure sensor values of the pressure sensors 43, 44, 45, 46 are provided to the control unit 19, the superordinate controller 15 and/or the cloud server 16.

The fluidic actuator 2 will be discussed in more detail below.

The fluidic actuator 2 is expediently a pneumatic actuator which can be acted upon by pressurized air. As an example, the fluidic actuator 2 is designed as a drive, especially as a drive cylinder. The fluidic actuator 2 comprises exemplarily an actuator body 7, the actuator member 3 and at least one pressure chamber 8, 9. The fluidic actuator 2 expediently comprises two pressure chambers 8, 9 which can be separately pressurized with the pressurized fluid and is designed in particular as a double-acting actuator. Alternatively, the fluidic actuator 2 can also have only one pressure chamber and accordingly be designed as a single-acting actuator.

The actuator body 7 is preferably adapted as a cylinder and has an internal volume. The actuator member 3 comprises, for example, a piston 5 and/or a piston rod 6. The piston 5 is located in the actuator body 7 and divides the internal volume of the actuator body 7 into the two pressure chambers 8, 9.

The fluidic actuator 2 expediently comprises the position sensor device 10. The position sensor device is used in particular to detect a position of the actuator member 3. The position sensor device 10 is exemplarily arranged outside on the actuator body 7. The position sensor device 10 comprises for example two position sensor units 11, 12, which are distributed along the movement path of the actuator member 3. Exemplarily, the position sensor units 11, 12 together cover the entire movement path of the actuator member 3.

For example, each position sensor unit 11, 12 may include one or more sensor elements, in particular magnetic sensor elements, such as Hall sensor elements. Expediently, a magnet is arranged on the actuator member 3, whose magnetic field can be detected by the magnetic sensor elements.

Expediently, the position sensor device 10 is adapted to detect the position of the actuator member 3 over the entire movement path of the actuator member 3.

At the fluidic actuator 2, there is expediently no pressure sensor, especially no pressure sensor for measuring a pressure in one of the pressure chambers 8, 9.

The system 100 expediently comprises a hose arrangement 28, via which the pressurized fluid provision device 4, in particular the valve arrangement 14, is fluidically connected to the fluidic actuator 2. A first hose 51 fluidically connects the first pressure output 23 with the first pressure chamber 8 and a second hose 52 fluidically connects the second pressure output 24 with the second pressure chamber 9. In an alternative design, in which the fluidic actuator 2 has only one pressure chamber, the hose arrangement 28 expediently comprises only one hose.

The superordinate controller 15 is exemplarily designed as a programmable logic controller, PLC, and is communicatively connected to the valve arrangement 14, in particular to the control unit 19. Expediently, the superordinate controller 15 is connected to the cloud server 16, especially via a wide area network 22, preferably via the internet. The superordinate controller 15 is expediently adapted to provide a setpoint signal SWS which defines the (setpoint) position to which actuator member 3 is controlled within the position control.

The user device 49 is exemplarily a mobile device, for example a smartphone, a tablet computer and/or a laptop. Furthermore, the user device 49 can be a desktop computer, for example a PC. The user device 49 is communicatively connected to the control unit 19, the cloud server 16 and/or the superordinate controller 15, in particular via a wide area network 22, for example the internet. The user device 49 is especially adapted for user input of the system parameter and/or the requirement parameter. The user device 49 can be used to access a user interface that is provided on the cloud server 16, the controller 15 and/or the control unit 19, for example. The user interface is expediently a web interface. The user interface is used in particular for the input of the system parameter and/or requirement parameter by the user. Furthermore, the user interface is preferably used to select, activate and/or load an application program that provides the below explained position controller and/or the assistance procedure to the control unit 19. In addition, the user device 49 is expediently adapted to operate and/or display the assistance procedure.

The cloud server 16 is expediently located away from the valve arrangement 14 and/or the fluidic actuator 2, especially in a different geographic location. Preferably, the cloud server 16 is adapted to provide an application program that provides the position control and/or the assistance procedure. The application program can be loaded from the cloud server 16 to the superordinate controller 15 and/or the control unit 19, expediently in response to a user input made with the user device 49.

Figure 2:
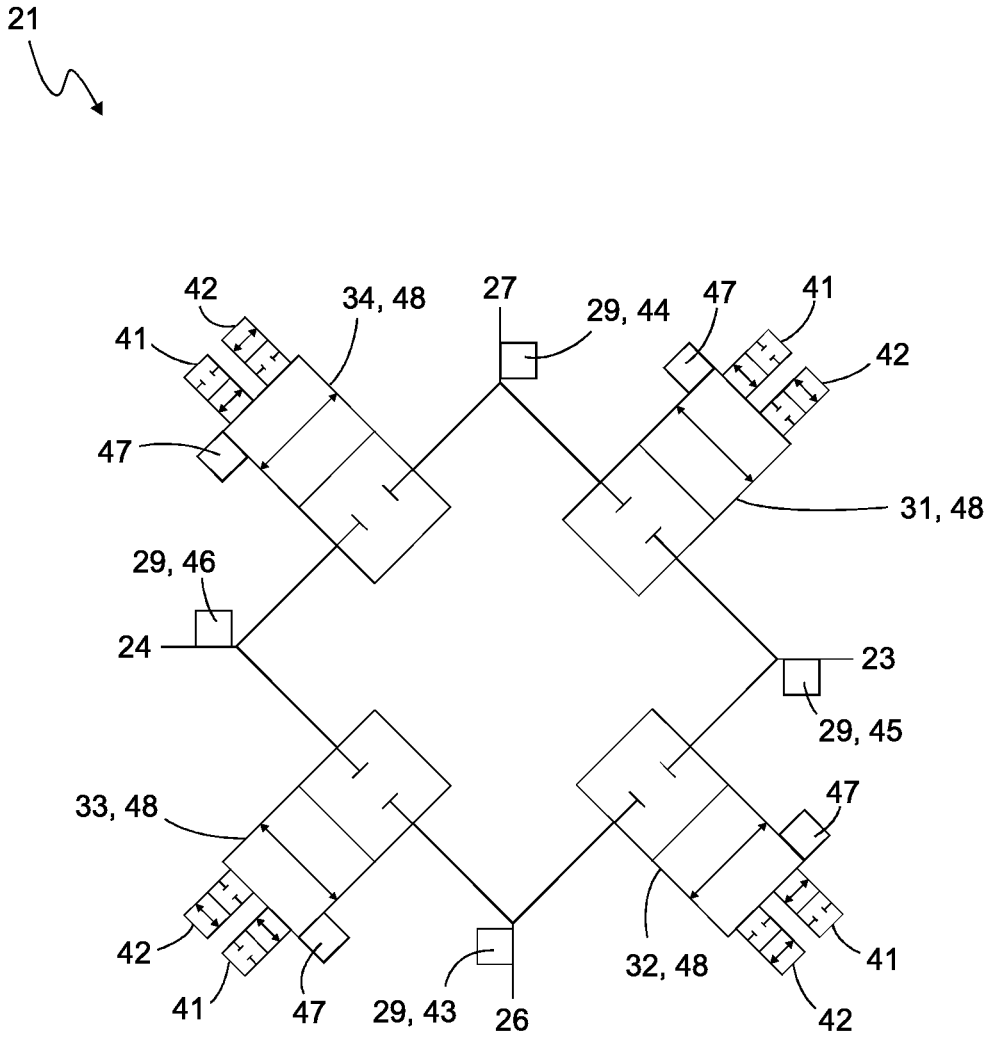

FIG. 2 shows an exemplary valve device 21, with which the pressures for the pressure chambers 8, 9 can be provided. The valve device 21 is part of the pressurized fluid provision device 4, in particular the valve arrangement 14, preferably a valve module 17.

The valve device 21 has the two pressure outputs 23, 24 with which two separate pressurized fluid pressures and/or two separate pressurized fluid mass flows can be provided. The valve device 21 also has an de-aeration port 26 connected to a de-aeration line and an aeration port 27 connected to an aeration line. Expediently, a supply pressure is applied to the aeration port 27 and/or the atmospheric pressure is applied to the de-aeration port 26.

The valve device 21 comprises one or more valve members 48 for each pressure output 23, 24, by means of which valve members 48 the size of a respective output opening can be adjusted, which the pressurized fluid passes through when providing the pressurized fluid at a respective pressure output 23, 24.

In FIG. 2, the valve device 21 is exemplarily designed as a full bridge of four 2/2-way valves 31, 32, 33, 34. A first 2/2-way valve 31 is connected between the aeration port 27 and the first pressure output 23, a second 2/2-way valve 32 is connected between the first pressure output 23 and the de-aeration port 26, a third 2/2-way valve is connected between the de-aeration port 26 and the second pressure output 24 and a fourth 2/2-way valve is connected between the second pressure output 24 and the aeration port 27.

The first pressure output 23 can be selectively connected via the first 2/2-way valve to the de-aeration line or via the second 2/2-way valve to the aeration line. The second pressure output 24 can be selectively connected via the third 2/2-way valve to the de-aeration line or via the fourth 2/2-way valve to the aeration line.

Each 2/2-way valve 31, 32, 33, 34 is exemplarily adapted as a proportional valve; i.e. each 2/2-way valve 31, 32, 33, 34 has a valve member 48 which can be set to an open position, a closed position and arbitrary intermediate positions between the open position and the closed position. Preferably, the 2/2-way valves 31, 32, 33, 34 are pilot operated valves, each of which has two pilot valves 41, 42 via which the valve member can be actuated. The pilot valves 41, 42 are exemplarily designed as piezo valves. The position of the respective valve member 48 can be used to adjust the above-mentioned output opening.

Exemplarily, the first and second 2/2-way valves 31, 32 form a first half bridge and the third and fourth 2/2-way valves 33, 34 form a second half bridge. Preferably, the output opening of the first pressure output 23 can be set via the first half bridge and the output opening of the second pressure output 24 can be set via the second half bridge.

The valve arrangement 14 expediently comprises the pressure sensor arrangement 29 with one or more pressure sensors to detect pressures of the valve arrangement 14, in particular the valve device 21.

As an example, the valve arrangement 14, in particular the valve device 21, comprises a first pressure output pressure sensor 45 for detecting the pressure provided at the first pressure output 23 and/or a second pressure output pressure sensor 46 for detecting the pressure provided at the second pressure output 24. Expediently, the valve arrangement 14, in particular the valve device 21, further includes a supply air pressure sensor 44 for detecting the pressure provided at the aeration port 27 and/or an exhaust air pressure sensor 43 for detecting the pressure provided at the de-aeration port 26.

The valve arrangement 14, especially the valve device 21, expediently comprises stroke sensors 47 for detecting the position of the valve members 48. The pressurized fluid provision device 4 is especially adapted to determine the size of the output openings of the pressure outputs 23, 24 by means of the stroke sensors 47.

In the following, the position control performed by the pressurized fluid provision device 4 will be discussed in more detail:

The pressurized fluid provision device 4 is expediently adapted to provide the position control over the entire movement path of the actuator member 3. Preferably, the pressurized fluid provision device 4 is adapted to position the actuator member 3 to an arbitrary position along the movement path by means of the position control. Expediently, the actuator member 3 can be positioned, by means of the position control, at any position along the movement path.

Preferably, the pressurized fluid provision device includes a position controller, which provides the position control of the actuator member 3. The position controller is expediently implemented as a program, in particular as an application program, which is executed in particular on the valve arrangement 14, preferably on the control unit 19. The position controller 50 is especially run on a microcontroller of the control unit 19. Alternatively or in addition, the position controller 50 can also be run on the cloud server 16 and/or the superordinate controller 15.

The position controller is expediently adapted to provide a actuating variable signal on the basis of a setpoint signal. The setpoint signal is provided by the control unit 19, the controller 15 and/or the cloud server 16, for example. Expediently, the setpoint signal includes a position setpoint signal. The valve arrangement 14 is adapted to control the valve device 21, in particular the 2/2-way valves 31, 32, 33, 34, in particular their pilot valves 41, 42, on the basis of the actuating variable signal. As an example, one or more conductance values are specified by the actuating variable signal, according to which conductance values the positions of the valve members 48—and thus the output openings of the pressure outputs 23, 24—are set.

The position controller is especially adapted to provide the actuating variable signal as a function of the setpoint signal and/or a measured quantity signal The measured quantity signal comprises expediently measured values of the position sensor device 10, the pressure sensor arrangement 29, in particular the pressure sensors 43, 44, 45, 46, and/or the stroke sensors 47. The measured quantity signal thus comprises in particular a measured position of the actuator member 3, a measured pressure at the de-aeration port 26, a measured pressure at the aeration port 27, a measured pressure at the pressure output 23, a measured pressure at the pressure output 24, and/or the measured positions of the valve members 48. The measured pressures can expediently be provided in the measured quantity signal as pressure differences. Furthermore, the measured positions can be provided as conductance values in the measured quantity signal. The pressurized fluid provision device 4, in particular the position controller, is adapted to take into account the at least one system parameter and/or the at least one requirement parameter in the position control of the actuator member 3.

The at least one system parameter describes a physical property of the system. For example, the at least one system parameter describes a friction, in particular a coefficient of friction and/or a friction force, which occurs during the positioning of the actuator member 3. Expediently, the system parameter includes a friction parameter that describes this friction. The friction includes, for example, the friction between the actuator member 3 and the actuator body 7, in particular between the piston 5 and the actuator body 7; alternatively or in addition, the friction expediently includes the friction between a drive object driven by the actuator member and a guide on which the drive object is supported.

Alternatively or additionally, the at least one system parameter describes a mass to be set in motion when positioning the actuator member 3. Expediently, the system parameter includes a mass parameter that describes this mass. For example, the mass includes the mass of the actuator member 3. Alternatively or additionally, the mass comprises the mass of the driving object driven by the actuator member 3.

Alternatively or additionally, the at least one system parameter describes a dynamic behavior of the valve device 21 of the pressurized fluid provision device. The term "dynamic behavior" refers in particular to a frequency response and/or bandwidth of the valve device 21, exemplarily one or more of the 2/2-way valves. The system parameter describes in particular how quickly the valve device 21, in particular one or more of the 2/2-way valves, react to a actuating variable signal; for example, how quickly the valve device 21 can provide a prescribed mass flow and/or pressure, and/or how quickly one or more of the 2/2-way valves can move their respective valve member 48 into a prescribed position.

The at least one requirement parameter expediently describes a requirement value for the positioning of the actuator member 3, for example a path requirement, in particular a path dynamic, for the actuator member 3. Exemplarily, the requirement parameter defines a requirement value for a velocity and/or acceleration and/or jerk and/or positioning duration, which is to be met when positioning the actuator. The at least one requirement parameter comprises for example an upper and/or lower limit value, in particular a velocity and/or acceleration limit value and/or jerk limit value. Furthermore, the requirement parameter can exemplarily define a minimum and/or maximum time period in which the positioning of the actuator member 3 has to take place.

Expediently, the pressurized fluid provision device 4, in particular the position controller, is adapted to calculate, on the basis of the system parameter and/or the requirement parameter, one or more controller parameters, for example controller gains, for the position control and to use these controller parameters for the position control. Preferably, the pressurized fluid provision device 4, in particular the position controller, is adapted to carry out a controller design on the basis of the system parameter and/or the requirement parameter in order to calculate the controller parameters, in particular the controller gains, for the position control. Expediently, the pressurized fluid provision device 4 is adapted to carry out, on the basis of the system parameter and/or the requirement parameter, an automatic parameterisation of the position control.

By means of the system parameter and/or the requirement parameter, the position control is thus adapted to a specific application and/or the fluidic actuator 2 and/or the valve device 21.

Expediently, the system 100 comprises a user interface for manual input of at least one system parameter and/or at least one requirement parameter. Expediently, the input takes place directly at the location of use of the system 100, for example when starting-up, e.g. commissioning, the system 100. Expediently, the position controller and/or the assistance procedure is provided in an application program and the input of the system parameter and/or the requirement parameter takes place by means of or in the application program. As an example, the above-mentioned user device 49 serves as the user interface.

The system parameter and/or the requirement parameter is therefore in particular a parameter entered by a user, for example via the user device 49. Such a parameter entered by a user shall also be referred to as a user parameter.

The pressurized fluid provision device 4 is expediently adapted to automatically trigger the assistance procedure, for example in a start-up mode and/or a normal operating mode of the pressurized fluid provision device 4. Alternatively or additionally, the user interface of the system 100, for example the user device 49, includes the function of manually—i.e. selectively effected by explicit user input—triggering the assistance procedure.

The pressurized fluid provision device 4 is in particular adapted to carry out the assistance procedure during the start-up, e.g. during commissioning, of the system 100 and/or during normal operation—i.e. during the intended normal operation in which, for example, a positioning of the actuator member 3 takes place as part of an industrial process and/or an industrial production. Expediently, the assistance procedure is executed on the control unit 19, the controller 15, the external cloud server 16 and/or the user device 49, especially as an application program.

Within the assistance procedure, the system parameter and/or the requirement parameter is determined and/or verified. This is done on the basis of a movement of the actuator member 3 and/or taking into account physical limits.

The determination and/or verification based on the movement of the actuator member 3 can be achieved, for example, by recording sensor values, for example the above-mentioned measured quantity signal, during the movement of the actuator member 3 and determining and/or verifying the system parameter and/or the requirement parameter on the basis of these sensor values and/or a motion model of the actuator member 3. The motion model expediently comprises one or more motion equations which define a dependence of the movement of the actuator member 3 and/or the sensor values on the at least one system parameter and/or requirement parameter. As an example, the pressurized fluid provision device 4, in particular the assistance procedure, is adapted to insert the sensor values detected during the movement of the actuator member 3 into the motion model and to solve the motion model according to the system parameter and/or requirement parameter. The solution then expediently serves as the determined system parameter and/or requirement parameter. Alternatively or additionally, the pressurized fluid provision device 4, in particular the assistance procedure, can be adapted to insert the system parameter and/or requirement parameter (in particular the parameter entered by the user) into the motion model and to check whether the movement of the actuator member 3 can be described by this. This check is then used as the basis for the verification of the system parameter and/or requirement parameter.

The sensor values of the measured quantity signal are used as sensor values for the determination and/or verification. In particular, the determination and/or verification is based on measured values of the position sensor device 10, the pressure sensor arrangement 29, in particular the pressure sensors 43, 44, 45, 46, and/or the stroke sensors 47.

The movement of the actuator member 3 used for the determination and/or verification of the system parameter and/or requirement parameter is expediently effected in a learning mode—for example in a start-up mode, e.g. a commissioning mode—as a learning run. Alternatively or in addition to this, the movement for the determination and/or verification of the system parameter and/or requirement parameter can preferably also be a movement of the actuator member 3 in the normal operation mode; i.e. in particular a movement performed by the actuator member 3 within an industrial process and/or (already) for a purpose other than the assistance procedure.

In the following, examples shall be explained, where a system parameter and/or requirement parameter is determined and/or verified within the assistance procedure on the basis of a movement of the actuator member 3 and/or a consideration of physical limits.

In a first example, the assistance procedure is adapted to automatically determine, as system parameter, a friction occurring during the positioning of the actuator member 3. The determination takes place in particular during start-up, e.g. commissioning, and, expediently, on the basis of a learning run of the actuator member 3. Exemplarily, the user triggers the assistance procedure. The assistance procedure then causes the actuator member 3 to carry out the learning run. The sensor values are recorded during the learning run. Based on the recorded sensor values and the motion model, a friction parameter is then calculated as a system parameter. Optionally, the assistance procedure outputs a message to the user that the determination of the system parameter was successful. Based on the calculated system parameter, the pressurized fluid provision device 4 adapts the position control.

When determining the system parameter, in particular the friction of the actuator 2, which is exemplarily designed as a drive cylinder, is identified by a learning run. For the determination of the system parameter, in particular a parameter optimization is carried out (for example, a recursive least-square method), especially on the motion equation, expediently a dynamic equation, of the drive cylinder.

In this way the start-up, e.g. commissioning, of the system 100 can be facilitated. Expediently, it is not necessary for the user to determine the system parameter by himself (which is a time-consuming process). In particular, the number of parameters to be entered by the user can be reduced, while maintaining or improving performance.

In a second example, the assistance procedure is adapted to verify, as a system parameter, a mass to be set in motion during the positioning of the actuator member 3. The verification is carried out in particular during start-up, e.g. commissioning, and, expediently, on the basis of a learning run of the actuator member 3. Exemplarily, the user triggers the assistance procedure. The assistance procedure then causes the actuator member 3 to carry out the learning run. The sensor values are recorded during the learning run. Based on the recorded sensor values and the motion model, a mass parameter previously entered by the user is then verified as a system parameter. Optionally, the assistance procedure outputs a notification to the user that the mass parameter entered by the user could be verified (or could not be verified). Alternatively or additionally, the assistant procedure is adapted to itself determine and/or correct the system parameter if verification fails.

In particular, the assistance procedure is adapted to verify a system parameter entered by the user, which system parameter comprises a mass of the drive cylinder, for example of the actuator member 3, by means of the learning run, in particular to validate its plausibility or to determine it, for example to identify it. For the determination of the system parameter, in particular a parameter optimization is carried out (for example, a recursive least-square method), especially on the motion equation, expediently a dynamic equation, of the drive cylinder.

In this way, a plausibility check of the user input is possible. This is particularly advantageous for the entered mass, since the entered mass is often a critical quantity for the automatic parameterization—for example, for the application-specific adaptation of the position control.

In a third example, the assistance procedure is adapted to verify a system parameter and/or requirement parameter (also referred to as "user parameter") entered by a user, taking into account physical limits. Expediently, this verification is not based on a movement of the actuator member 3, in particular not on recorded sensor values.

As an example, the user enters the system parameter and/or the requirement parameter for the position control and triggers the assistance procedure. Alternatively, the assistance procedure may be triggered automatically when the system parameter and/or requirement parameter is entered. The assistance procedure then checks whether the system parameter and/or requirement parameter is physically possible, taking into account physical limits, in particular by using physical equations.

The physical limits are in particular physical limits of the system 100.

For example, it is checked whether the positioning is at all physically possible with the valve device 21, in particular the pneumatic specification of the valve device 21, and/or the actuator 2, taking into account the system parameter and/or the requirement parameter. For example, it is checked whether a mass entered as a system parameter can be set in motion at all by means of the fluidic actuator 2 and/or whether a velocity and/or time specification entered as a requirement parameter can be fulfilled by the valve device 21. Optionally, the assistance procedure outputs a notification to the user that the system parameter and/or the requirement parameter entered by the user could be verified (or could not be verified). Alternatively or additionally, the assistant procedure is adapted to itself determine and/or correct the system parameter if the verification fails.

Furthermore, the assistance procedure is exemplarily adapted to provide the user with a recommendation value for the system parameter and/or requirement parameter on the basis of a movement of the actuator member 3 and/or under consideration of the physical limits.

In this way, a plausibility check of the system parameter (concerning in particular the drive, a mass and/or the valve device) and/or a path requirement defined by a requirement parameter can be carried out by applying the physical equations. In particular, a dynamic limitation (which results, for example, from pneumatics and/or a actuating variable limitation) is calculated and/or communicated to the user. In this way, assistance can be provided for a meaningful basic parameterization.

In a fourth example, the assistance procedure is adapted to determine, as a system parameter, a dynamic behavior of the valve device 21, especially in the normal operating mode, and to determine a state of wear of the valve device 21 on the basis of the system parameter.

For example, the assistance procedure runs automatically in the normal operating mode and/or is triggered manually by the user. The assistance procedure records sensor values during a movement of the actuator member 3. On the basis of the recorded sensor values and the motion model, the assistance procedure then determines the dynamic behavior of the valve device 21 as a system parameter. Furthermore, the assistance procedure determines a state of wear of the valve device 21 on the basis of the system parameter.

Optionally, the assistance procedure outputs to the user a notification about the determined system parameter and/or the state of wear.

In particular, a predictive maintenance function can be implemented in this way. Expediently, the valve dynamics are monitored during operation, i.e. in the normal operating mode. In particular (for monitoring purposes) no special (interfering) actuating variables are induced.

The determination of the dynamic behavior is carried out in particular by applying parameter optimisation (e.g. recursive least-square method) to a dynamic equation of the valve device 21. This is expediently carried out by the assistance procedure. In this way it is possible, in particular, to achieve an early detection of aging and/or a defect which could influence the valve dynamics (bandwidth and/or damping) in such a way that safe functioning of the valve device 21 would no longer be guaranteed for the application. Expediently, the assistance procedure is adapted to output to the user a message about the state of wear, in particular the aging and/or the defect.

In a fifth example, the determination of the state of wear is carried out on the basis of a friction determined as a system parameter (as an alternative or in addition to the above explained determination on the basis of the dynamic behavior of the valve device 21). In particular, the assistance procedure monitors the friction of the fluidic actuator 2 during operation, i.e. in the normal operating mode. In particular (for monitoring purposes) no special (interfering) actuating variables are induced.

The determination of the friction as a system parameter is expediently carried out by applying parameter optimization (e.g. a recursive least-square method) to a dynamic equation of the fluidic actuator 2.

In this way, an early detection of aging and/or a defect is possible, which could influence the behavior (especially the friction) of the fluidic actuator 2 in such a way that a safe function of the fluidic actuator 2 would no longer be guaranteed for the application. Expediently, the assistance procedure is adapted to output to the user a message about the state of wear, in particular the aging and/or the defect.

What is claimed is:

1. A system comprising:

a fluidic actuator which can be acted upon by a pressurized fluid, the fluidic actuator having an actuator member; and a pressurized fluid provision device which is adapted to carry out a position control of the actuator member and, within the position control, to apply the pressurized fluid to the fluidic actuator in order to move the actuator into a prescribed position, wherein the pressurized fluid provision device is adapted to perform the position control taking into account at least one system parameter describing a physical property of the system and/or at least one requirement parameter defining a requirement for the positioning of the actuator member, wherein the pressurized fluid provision device is further adapted to perform an assistance procedure and, within the assistance procedure, to determine and/or verify the at least one system parameter and/or the at least one requirement parameter on the basis of a movement of the actuator member and/or a consideration of physical limits, and wherein the at least one requirement parameter comprises at least one of a velocity limit value, an acceleration limit value, and a jerk limit value, and wherein the at least one system parameter describes at least one of a friction occurring during the positioning of the actuator member, a mass to be set in motion when positioning the actuator member, and a dynamic behaviour of a valve device of the pressurized fluid provision device.

2. The system according to claim 1, wherein the pressurized fluid provision device is adapted to enter a learning mode and, in the learning mode, to cause, by application of pressurized fluid, a learning run of the actuator member, so as to provide the movement of the actuator member for the assistance procedure.

3. The system according to claim 1, wherein the pressurized fluid provision device is adapted to enter a normal operating mode in which the pressurized fluid provision device performs the position control according to a prescribed setpoint signal, and to provide, within the position control in the normal operating mode, the movement of the actuator member for the assistance procedure.

4. The system according to claim 1, wherein the at least one system parameter and/or the at least one requirement parameter is a user entered parameter and the system is adapted to verify, within the assistance procedure, the user entered parameter on the basis of the movement of the actuator member and/or the consideration of physical limits.

5. The system according to claim 1, wherein the pressurized fluid provision device is adapted to determine, within the assistance procedure, the at least one system parameter and to determine a state of wear of the pressurized fluid provision device and/or the fluidic actuator on the basis of the determined system parameter.

6. The system according to claim 1, wherein the at least one system parameter and/or the at least one requirement parameter is a user entered parameter and the system is adapted to provide, within the assistance procedure, the user with a recommendation value for the user entered parameter, the recommendation value being based on the movement of the actuator member and/or the consideration of the physical limits.

7. A method of operating a system, the system comprising:

a fluidic actuator which can be acted upon by a pressurized fluid, the fluidic actuator having an actuator member; and a pressurized fluid provision device which is adapted to carry out a position control of the actuator member and, within the position control, to apply the pressurized fluid to the fluidic actuator in order to move the actuator into a prescribed position, wherein the pressurized fluid provision device is adapted to perform the position control taking into account at least one system parameter describing a physical property of the system and/or at least one requirement parameter defining a requirement for the positioning of the actuator member, wherein the pressurized fluid provision device is further adapted to perform an assistance procedure and, within the assistance procedure, to determine and/or verify the at least one system parameter and/or the at least one requirement parameter on the basis of a movement of the actuator member and/or a consideration of physical limits, wherein the at least one requirement parameter comprises at least one of a velocity limit value, an acceleration limit value, and a jerk limit value, and wherein the at least one system parameter describes at least one of a friction occurring during the positioning of the actuator member, a mass to be set in motion when positioning the actuator member, and a dynamic behavior of a valve device of the pressurized fluid provision device, the method comprising the step:

performing the assistance procedure.

8. A method for operating a system, the system comprising:

a fluidic actuator which can be acted upon by a pressurized fluid, the fluidic actuator having an actuator member; and a pressurized fluid provision device for providing the pressurized fluid, the method comprising the steps of:

the pressurized fluid provision device carrying out a position control of the actuator member, and, within the position control, applying the pressurized fluid to the fluidic actuator in order to move the actuator into a prescribed position, the pressurized fluid provision device performing the position control taking into account at least one system parameter describing a physical property of the system and/or at least one requirement parameter defining a requirement for the positioning of the actuator member, the pressurized fluid provision device performing an assistance procedure and, within the assistance procedure, determining and/or verifying the at least one system parameter and/or the at least one requirement parameter on the basis of a movement of the actuator member and/or a consideration of physical limits, wherein the at least one system parameter and/or the at least one requirement parameter is a user parameter to be entered by a user providing, within the within the assistance procedure, the user with a recommendation value for the user parameter to be entered by the user.

* * * * *